US009806417B2

(12) United States Patent
Niu

(10) Patent No.: US 9,806,417 B2
(45) Date of Patent: Oct. 31, 2017

(54) ANTENNA SYSTEM AND MOBILE TERMINAL

(71) Applicant: Lenovo (Beijing) Co., Ltd., Beijing (CN)

(72) Inventor: Jiaxiao Niu, Beijing (CN)

(73) Assignee: LENOVO (BEIJING) CO., LTD., Haidian District, Beijing (CN)

( * ) Notice: Subject to any disclaimer, the term of this patent is extended or adjusted under 35 U.S.C. 154(b) by 126 days.

(21) Appl. No.: 14/673,037

(22) Filed: Mar. 30, 2015

(65) Prior Publication Data

US 2016/0190682 A1 Jun. 30, 2016

(30) Foreign Application Priority Data

Dec. 24, 2014 (CN) ..... 2014 1 0817848

(51) Int. Cl.
*H01Q 1/50* (2006.01)
*H01Q 5/335* (2015.01)
*H01Q 1/24* (2006.01)

(52) U.S. Cl.
CPC ..... *H01Q 5/335* (2015.01); *H01Q 1/243* (2013.01)

(58) Field of Classification Search
CPC ..... H01Q 1/50; H01Q 9/04
USPC ..... 343/861
See application file for complete search history.

(56) References Cited

U.S. PATENT DOCUMENTS 3,909,830 A * 9/1975 Campbell ..... H01Q 9/32 343/703
4,335,469 A * 6/1982 Tharp ..... H03H 7/38 343/703
6,246,374 B1 * 6/2001 Perrotta ..... H01Q 1/242 343/702
7,343,138 B2 * 3/2008 Bengtson ..... H03F 1/56 455/103
8,629,813 B2 * 1/2014 Milosavljevic ..... H01Q 1/243 343/850
2002/0053947 A1 * 5/2002 Macedo ..... H03F 1/302 330/151
2006/0270367 A1 * 11/2006 Burgener ..... H01Q 23/00 455/127.1
2007/0194628 A1 * 8/2007 Kirchmeier ..... H03H 7/38 307/155
2008/0227408 A1 * 9/2008 Hsiao ..... H01Q 9/145 455/77
2008/0238802 A1 * 10/2008 Fukushima ..... H01Q 1/3275 343/841
2013/0214979 A1 * 8/2013 McMilin ..... H01Q 9/42 343/750

(Continued)

*Primary Examiner* — Huedung Mancuso
(74) *Attorney, Agent, or Firm* — Brinks Gilson & Lione; G. Peter Nichols

(57) ABSTRACT

An antenna system and a mobile terminal are disclosed. The antenna system includes an antenna radiator and an adjustable matching circuit connected between the antenna radiator and a radio frequency interface. The adjustable matching circuit adjusts the resistance between the antenna radiator and the radio frequency interface according to a plurality of frequency bands. The antenna radiator in the embodiments of the present disclosure is a metallic body of strip shape, which has a simple structure and is easy to implement and can be combined with the adjustable matching circuit to implement coverage of a larger range band width.

11 Claims, 3 Drawing Sheets

(56) References Cited

U.S. PATENT DOCUMENTS

| | | | | |
|---|---|---|---|---|
| 2014/0051375 | A1* | 2/2014 | Hung | H04B 1/16<br>455/193.1 |
| 2014/0194075 | A1* | 7/2014 | Black | H04B 1/40<br>455/77 |

* cited by examiner

ANTENNA SYSTEM AND MOBILE TERMINAL

This application claims priority to Chinese Patent Application No. 201410817848.3 filed on Dec. 24, 2014, the entire contents of which are incorporated herein by reference.

This disclosure relates to field of mobile communication, and more particularly to an antenna system and a mobile terminal.

BACKGROUND

At present, a structure of the mobile terminal such as a mobile phone or the like becomes more and more complex, and a space for an antenna becomes smaller and smaller. Smallness of the space of the antenna means that a band width of the antenna would become narrow. At the same time, in practical use, since it needs to cover various different communication standards, the antenna needs to cover a plurality of frequency bands generally. At present, a general low frequency band of the antenna needs to cover 824-960 MHz, and a high frequency band thereof needs to cover 1710-2170 MHz. In company with LTE (Long Term Evolution) entering into market fast, the antenna also needs to cover a frequency band of the LTE. In a representative LTE system, a lowest frequency band is 698 MHz. It means that the low frequency band of the antenna needs to cover 698-960 MHz. In case of a space condition that the antennae can use at present, a band width with such width can't be satisfied by solutions.

SUMMARY

The embodiments of the present disclosure provide an antenna system and a mobile terminal which are able to implement wide frequency band coverage by a simple antenna structure.

In one aspect, there provides an antenna system comprising: an antenna radiator; and an adjustable matching circuit connected between the antenna radiator and a radio frequency interface, wherein the adjustable matching circuit is for adjusting a resistance between the antenna radiator and the radio frequency interface according to a plurality of frequency bands.

In another aspect, there provides a mobile terminal including a radio frequency interface; an antenna radiator and an adjustable matching circuit connected between the antenna radiator and a radio frequency interface, wherein the adjustable matching circuit is for adjusting a resistance between the antenna radiator and the radio frequency interface, so as to enable the mobile terminal to support a plurality of frequency bands.

BRIEF DESCRIPTION OF THE DRAWINGS

In order to explain technical solution in the embodiments in the present disclosure more clear, the accompanying drawings needs to be used in the description in the embodiments in the present disclosure or the prior arts are described simply, it is obvious that the accompanying drawings in the following description are only some embodiments in the present disclosure, and for those skilled in the art, other accompanying drawings can be obtained according to these accompanying drawings without inventive labor.

DETAILED DESCRIPTION

The technical solution in the embodiments of the present disclosure are described clearly and integrated in combination with accompanying drawings in the embodiments of the present disclosure hereinafter, it is obvious that the described embodiments are only a part of embodiments of the present disclosure instead of all of the embodiments. All of the other embodiments obtained by those skilled in the art without inventive labor based on embodiments in this disclosure belong to a scope sought for protection of this disclosure.

The technical solution of this disclosure can be applied in various kinds of communication systems or communication protocols, for example, a global mobile communication system (GSM), a code division multiple access (CDMA) system, a wideband code division multiple access (WCDMA), a general packet radio service (GPRS), a long term evolution (LTE), and so on.

A user equipment (UE), which is also referred as a mobile terminal, a mobile user equipment or the like, can communicate with one or more kernel network via a wireless access network (for example, a radio access network), and the user equipment can be the mobile terminal, for example, a mobile telephone (or referred as a "cell" phone) and a computer having the mobile terminal, for example, it can be a portable, a pocket, a hand-held, a computer built-in or a vehicle mounted mobile device which exchanges language and/or data with the wireless access network.

It should note that, in the embodiments of the present disclosure, when an element is described as being connected to another element, this "connection" can be a direct connection, for example, these two elements are contacted directly (for example, with a feed point or a contact point or the like) or connected via a connecting line simply (for example, a wire, a feed line or the like). And this "connection" can be an indirect connection, for example, these two elements are interconnected via one or more other elements (for example, a capacitor, an inductor, a resistor, a switch device or a combination of these elements or the like).

Further, this disclosure does not limit manners of the "connection", for example, it can be an electrical connection, a physical connection, a near field connection or the like.

Figure 1:
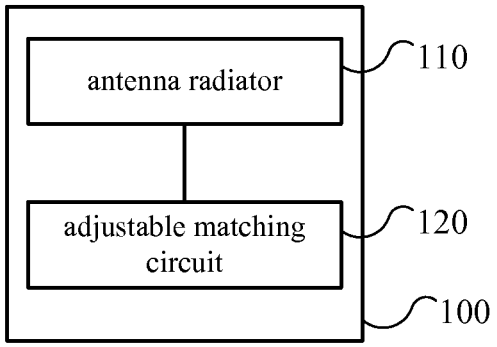
FIG. 1 is a schematic block diagram of an antenna system of one embodiment of this disclosure.

FIG. 1 is a schematic block diagram of an antenna system 100 of one embodiment of this disclosure. The antenna system 100 may be arranged in a mobile terminal in FIG. 1. The antenna system 100 can support a wide frequency band constituent of a plurality of frequency bands.

As shown in FIG. 1, the antenna system 100 includes an antenna radiator 110 and an adjustable matching circuit 120.

The antenna radiator 110 is a metallic body of strip shape as an excitation source to excite a floor of the mobile terminal to radiate. A length of the metallic body of strip shape is less than a resonant length of a lowest frequency band in the plurality of frequency bands of the above-described wide frequency band.

The adjustable matching circuit 120 is connected between the antenna radiator 110 and a radio frequency interface of the mobile terminal and for adjusting a resistance between the antenna radiator 110 and the radio frequency interface to be switched between the plurality of frequency bands of the above-described wide frequency band, so as to match with an operating frequency band of the antenna system 100.

The antenna radiator in the embodiments of the present disclosure is the metallic body of strip shape, which has a simple structure and easy to implement and can be combined with the adjustable matching circuit to implement a coverage of band width of larger range.

In particular, a structure of the antenna radiator is relatively complex at present, and cost and difficulty of production are relatively high, and in the embodiments, the metallic body of strip shape is used as the antenna radiator 110, which has a simple structure and easy to implement and easy to be installed, which saves an inner space of the mobile terminal.

In general, the antenna radiator 110 is made of a metallic sheet as the exciting source to excite a floor of a whole mobile phone to radiate, and a plane with largest area is a rectangle or an approximate rectangle (for example, two adjacent edges of the metallic sheet can have a certain angle, or there can be holes on the metallic sheet).

In an alternate embodiment, when the antenna radiator 110 is installed in the mobile terminal, the plane can be in parallel or substantially parallel with a front face of the mobile terminal (it is generally a plane on which a display screen of the mobile terminal is). This plane has long side and short sides. In an alternate embodiment, a length of a long side of the metallic body of strip shape constituting the antenna radiator 110 is shorter than or equal to a half of a length or a short side of the mobile terminal (that is, a short side of the above-described front face of the mobile terminal). Thus, since the length of the short side of the mobile terminal is generally 40-60 mm, the length of the metallic body of strip shape can be 20-30 mm, which is lower than a length required by a low frequency resonance greatly, and which is able to satisfy for example a requirement of a low-frequency band coverage of the LTE system.

Alternatively, as another embodiment, the antenna radiator 110 can be arranged so that the long side of the metallic body of strip shape is parallel with the short side of the mobile terminal. This facilitates an installation of the antenna radiator 110.

Figure 2:
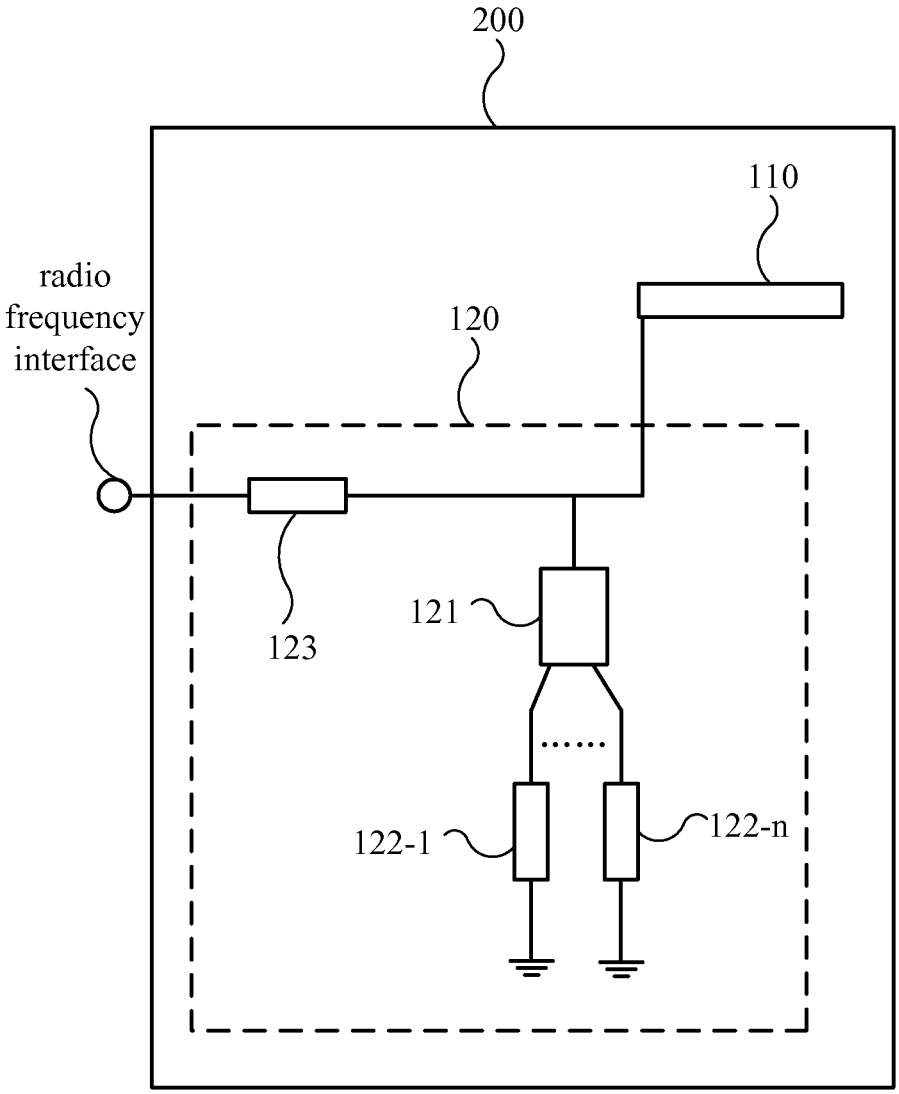
FIG. 2 is a schematic block diagram of an antenna system of another embodiment of this disclosure.

FIG. 2 is a schematic block diagram of an antenna system 200 of another embodiment of this disclosure. In the antenna system 200 in FIG. 2, same or similar parts as in FIG. 1 adopts same or similar reference number, and repetitive description thereof is omitted appropriately.

The antenna system 200 in FIG. 2 depicts an alternate structure of the adjustable matching circuit. As shown in FIG. 2, the adjustable matching circuit 120 includes a first switch adjustable device 121 and a plurality of regulating elements 122-1 to **122-*n***. Here, n is a positive integer.

A first end of the first switch adjustable device 121 is connected with the antenna radiator 110, a second end of the first switch adjustable device 121 is connected with first ends of the regulating elements 122-1 to **122-*n*, respectively, so that the first switch adjustable device 121 can be switched between the regulating elements 122-1 to 122-*n***.

Second ends of the regulating elements 122-1 to **122-*n*** are grounded.

Each regulating element of the regulating elements 122-1 to **122-*n* includes a capacitor and/or an inductor, and elements included in different regulating element are different from each other. Thus, each regulating element can implement different resistances, so as to be able to support different frequency bands through switch between the regulating elements 122-1 to 122-*n***. However, this disclosure does not limit element types included by the regulating element. For example, in addition to the capacitor and the inductor, the regulating element can also include other elements such as a resistor. These capacitor, inductor or resistor devices can be fixed parameter, or adjustable.

Thus, by switching between the regulating elements 122-1 to **122-*n* of the first switch adjustable device 121, the resistance between the antenna radiator 110** and the radio frequency interface of the mobile terminal can be adjusted, so that an impedance matching in a frequency band of corresponding status is best, so as to implement a maximum power transmission and radiation.

Therefore, a structure of the antenna radiator in the embodiments of the present disclosure is simple, it does not need a low frequency band resonance itself, and thus the length can be reduced greatly, which very adapts to a strict requirement to the space of the mobile terminal. A structure of the adjustable matching circuit can be relatively simple, for example, it only needs one switch 121.

As shown in FIG. 2, the adjustable matching circuit 120 can also include a second switch adjustable device 123. The second switch adjustable device 123 is an optional device. A first end of the second switch adjustable device 123 is connected with the radio frequency interface, and a second end of the second switch adjustable device 123 is connected with the antenna radiator 110.

Alternatively, as one embodiment, the switch adjustable device 121/123 in this disclosure can include a switch device or an adjustable capacitor. Further, in the switch adjustable device 121/123 or the antenna system, fixed or adjustable matching devices can be added as required to optimize the antenna matching. For example, devices such as the inductor or the capacitor or the like can be added between the antenna radiator 110 and the switch adjustable device 121/123 (not shown in FIG. 2).

Alternatively, as another embodiment, the antenna system can also include an antenna bracket. The antenna radiator can be fixed on the antenna bracket, for example, by means of pasting, a screw, a slot, a rivet or the like. The adjustable matching circuit can be accommodated in the antenna bracket. However, this disclosure does not make any limitation to manners of installing the antenna radiator and the adjustable matching circuit.

Grounding of the regulating elements 122-1 to **122-*n* can be implemented by a grounding circuit of interior of the adjustable matching circuit 120, and can by the aid of a grounding circuit of exterior of the adjustable matching circuit 120** (for example, which is connected to the floor of the mobile terminal).

Figure 3:
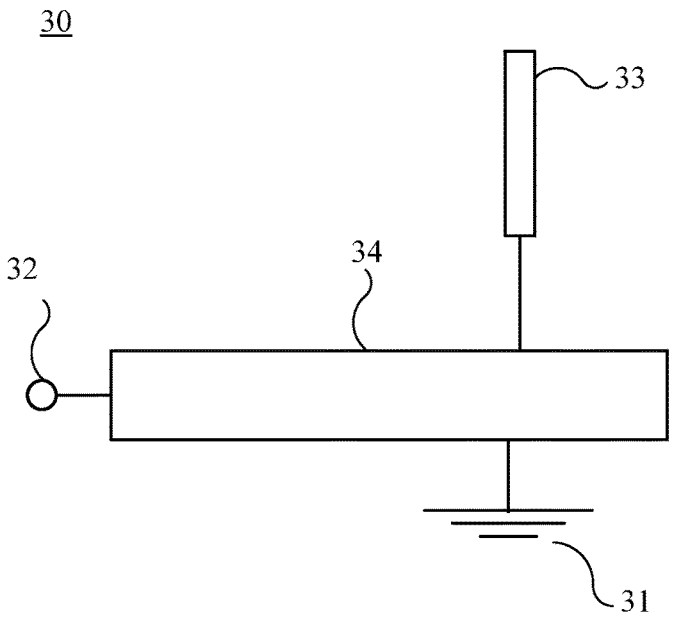
FIG. 3 is a schematic block diagram of a mobile terminal of one embodiment of this disclosure.

FIG. 3 is a schematic block diagram of a mobile terminal 30 of one embodiment of this disclosure. The mobile terminal 30 in FIG. 3 includes a floor 31, a radio frequency interface 32, an antenna radiator 33 and an adjustable matching circuit 34.

The mobile terminal 30 supports a wide frequency band constituent of a plurality of frequency bands.

The antenna radiator 33 is a metallic body of strip shape as an excitation source to excite the floor 31 to radiate. A length of the metallic body of strip shape is less than a resonant length of a lowest frequency band in the above-described plurality of frequency bands.

The adjustable matching circuit 34 is connected between the antenna radiator 33 and the radio frequency interface 32 and for adjusting a resistance between the antenna radiator 33 and the radio frequency interface 32 to be switched between the above-described plurality of frequency bands, so as to match with an operating frequency band of the mobile terminal.

The adjustable matching circuit 34 is further connected to a floor 35.

The antenna radiator in the embodiments of the present disclosure is the metallic body of strip shape, which has a simple structure and easy to implement and can be combined with the adjustable matching circuit to implement a coverage of band width of larger range.

The floor 35 can be referred as a grounding plate, for example, it can be a metallic plate having relatively large area, for example, deposited in a housing of the mobile terminal 30 or as a part of the housing of the mobile terminal 30.

The antenna radiator 33 can be similar to the antenna radiator 110 in FIG. 1 or FIG. 2. For example, as an alternative embodiment, a length of a long side of the metallic body of strip shape constituting the antenna radiator 33 is shorter than or equal to a half of a length of a short side of the mobile terminal 30.

Alternatively, as another embodiment, the antenna radiator 33 can be arranged so that the long side of the metallic body of strip shape is parallel with the short side of the mobile terminal 30.

An alternative structure of the adjustable matching circuit 34 can be similar to that of the adjustable matching circuit 120 in FIG. 2. It is no longer described detailed in order to avoid redundancy.

For example, as an alternative embodiment, the adjustable matching circuit 34 can include a first switch adjustable device and a plurality of regulating elements. A first end of the first switch adjustable device is connected with the antenna radiator 33, and a second end of the first switch adjustable device is connected with first ends of the regulating elements, respectively, so that the first switch adjustable device can be switched between the regulating elements. Second ends of the regulating elements are connected to the floor 31 respectively. Each regulating element of the plurality of regulating elements includes a capacitor and/or an inductor, and elements included in different regulating element are different from each other.

The adjustable matching circuit 34 can also include a second switch adjustable device. A first end of the second switch adjustable device is connected with the radio frequency interface 32, and a second end of the second switch adjustable device is connected with the antenna radiator 33.

Figure 4:
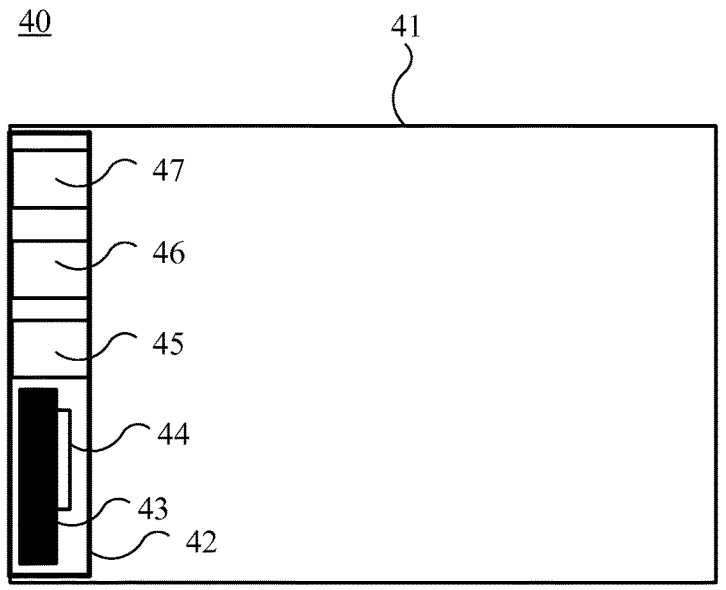
FIG. 4 is a schematic structural diagram of a mobile terminal of another embodiment of this disclosure.

FIG. 4 is a schematic structural diagram of a mobile terminal 40 of another embodiment of this disclosure. FIG. 4 only depicts a part of structure of the mobile terminal 40.

As shown in FIG. 4, the mobile terminal 40 has a floor 41. The floor 41 is generally made of a metallic sheet having relatively large area, and can be deposited in housing of the mobile terminal 40 or as a part of the housing of the mobile terminal 40.

Further, the mobile terminal 40 has an antenna bracket 42. In an example of FIG. 4, the antenna bracket 42 is at a side of the mobile terminal 40 (for example, a bottom side of the mobile terminal 40). The antenna radiator 43 and the adjustable matching circuit 44 are installed in the mobile terminal 40 by the antenna bracket 42 (FIG. 4 only schematically depict a part of the adjustable matching circuit 44). For example, the antenna radiator 43 constituent of a metallic body of strip shape can be installed on the antenna bracket 42, and the adjustable matching circuit 44 can be accommodated in interior of the antenna bracket 42. But, this disclosure does not limit manners of installing the antenna radiator 43 and the adjustable matching circuit 44, for example, a part of elements of the adjustable matching circuit 44 can be installed on the antenna bracket 42 or installed in exterior of the antenna bracket 42.

Other devices, for example a USB (Universal Serial Bus) interface 45, a speaker 46 and a microphone 47 or the like can be installed on the antenna bracket 42, thus, inner space of the mobile terminal 40 can be fully utilized. The USB interface 45 can be used as a data interface and/or a power supply interface.

The antenna radiator 43 can form a part of the housing of the mobile terminal 40 totally or partly if required, thus, the inner space of the mobile terminal 40 can be further saved.

As shown in FIG. 4, a length of the antenna radiator 43 is shorter than or equal to a half of a length of the bottom side of the mobile terminal (which corresponds to the above-described "short side of the mobile terminal" in FIG. 1-FIG. 3), for example, it may be a length of 20-30 mm, which is less than a length required by the low frequency resonance greatly, thus, a coverage of larger band width can be implemented in combination with the adjustable matching circuit 44.

One example of the structure of the adjustable matching circuit 44 is shown with reference to FIG. 2, and there no longer describes detailed in order to avoid redundancy.

Therefore, the antenna radiator in the embodiments of the present disclosure is the metallic body of strip shape, which has a simple structure and easy to implement and can be combined with the adjustable matching circuit to implement a coverage of band width of larger range.

Those skilled in the art can realize that, the units and the algorithm steps of the respective examples described in combination with the embodiments disclosed in this specification can be implemented by electronic hardware, or a combination of computer software and the electronic hardware. Whether these functions are executed in manners of hardware or software depends on specific applications and design constraints of technical solutions. Those skilled in the art can implement the described functions by using different methods for each specific application, and such implementations are not regarded as beyond the scope of the disclosure.

Those skilled in the art can understand clearly that, for convenience and simplicity of description, a specific operating procedure of the above-described system, device and unit can refer to a corresponding procedure of the above-described embodiment of method, and it is no longer described here.

In the several embodiments provided by this disclosure, it is understood that the disclosed system device and method can be implemented by other means. For example, the above-described embodiments of the device are only schematic, for example, the division of the units is only a logical functional division, and there can be other manners of division in the actual implementation, for example, a plurality of units or components can be combined or integrated into another system, or some features can be neglected or are not implemented. In another point, coupling or direct coupling or communication connection between the respective constituent parts shown or discussed may be indirect coupling or communication connection through some interfaces, device or units, and may be electrical, mechanical or other forms.

The units explained as separate components may be, or may not be separated physically, and the components shown as units may be or may not be physical units, that is, they may be positioned at one location, or may also be distributed to a plurality of network units. Object of the solutions of the embodiments can be implemented by selecting some or all of the units according to actual requirement.

Further, all of the respective functional units in the respective embodiments of this disclosure may be integrated into one processing unit, or the respective units may be as a separate unit respectively, or two or more units may be integrated into one unit.

The above mentioned is only the detailed implementation of this disclosure, but the range sought for protection of this disclosure is not limited thereto, variations or replacements thought out by those skilled in the art easily in the technical range disclosed in this disclosure should be covered within the range sought for protection by this disclosure. Therefore, the range sought for protection by this disclosure is defined by the range sought for protection of the claims.

The invention claimed is:

1. An antenna system comprising:

an antenna radiator; and an adjustable matching circuit connected between the antenna radiator and a radio frequency interface, wherein the adjustable matching circuit adjusts a resistance between the antenna radiator and the radio frequency interface according to a plurality of different frequency bands, wherein the adjustable matching circuit comprises a first switch adjustable device and a plurality of regulating elements, a first end of the first switch adjustable device being connected with the antenna radiator, and a second end of the first switch adjustable device being connected with first ends of the regulating elements respectively, so that the first switch adjustable device can be switched between the regulating elements;

second ends of the regulating elements being grounded; and each regulating element comprising a capacitor or an inductor, or both;

wherein the adjustable matching circuit further comprises a second switch adjustable device, a first end of the second switch adjustable device being connected with the radio frequency interface, and a second end of the second switch adjustable device being connected with the antenna radiator.

2. The antenna system according to claim 1, wherein the antenna radiator is a metallic strip.

3. The antenna system according to claim 2, wherein a length of the metallic strip is shorter than a resonant length of a lowest frequency band among the plurality of frequency bands.

4. The antenna system according to claim 1, wherein the first switch adjustable device comprises a switch device or an adjustable capacitor.

5. The antenna system according to claim 1, wherein the second switch adjustable device comprises a switch device or an adjustable capacitor.

6. The antenna system according to claim 1, further comprising an antenna bracket to which the antenna radiator is fixed and in which the adjustable matching circuit is accommodated.

7. A mobile terminal comprising:

a radio frequency interface;

an antenna radiator; and an adjustable matching circuit connected between the antenna radiator and a radio frequency interface, wherein the adjustable matching circuit is for adjusting a resistance between the antenna radiator and the radio frequency interface, so as to enable the mobile terminal to support a plurality of frequency bands;

wherein the adjustable matching circuit comprises a first switch adjustable device and a plurality of regulating elements, a first end of the first switch adjustable device being connected with the antenna radiator, and a second end of the first switch adjustable device being connected with first ends of the regulating elements respectively, so that the first switch adjustable device can be switched between the regulating elements;

second ends of the regulating elements being grounded; and each regulating element comprising a capacitor or an inductor, or both;

wherein the adjustable matching circuit further comprises a second switch adjustable device, a first end of the second switch adjustable device being connected with the radio frequency interface, and a second end of the second switch adjustable device being connected with the antenna radiator.

8. The mobile terminal according to claim 7, wherein the antenna radiator is a metallic strip.

9. The mobile terminal according to claim 8, wherein a length of a long side of the metallic strip is shorter than or equal to a half of a length of a short side of the mobile terminal.

10. The mobile terminal according to claim 8, wherein the antenna radiator is arranged so that the long side of the metallic strip is parallel with the short side of the mobile terminal.

11. The mobile terminal according to claim 8, wherein a length of the metallic strip is shorter than a resonant length of a lowest frequency band of the plurality of frequency bands.

* * * * *